US006640971B2

(12) United States Patent
Acevedo

(10) Patent No.: US 6,640,971 B2
(45) Date of Patent: Nov. 4, 2003

(54) CARTON FOR CONTAINING AN OBJECT DURING TRANSPORT AND STORAGE AND UNITARY BLANK THEREFOR

(75) Inventor: Angel W. Acevedo, Richmond, VA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 9 days.

(21) Appl. No.: 09/924,326

(22) Filed: Aug. 8, 2001

(65) Prior Publication Data

US 2003/0029753 A1 Feb. 13, 2003

(51) Int. Cl.[7] ..... B65D 85/00
(52) U.S. Cl. ..... 206/320; 206/521; 206/765
(58) Field of Search ..... 206/320, 722–724, 206/590–593, 588, 576, 521, 765, 585, 586, 587, 598; 229/120.17

(56) References Cited

U.S. PATENT DOCUMENTS

| | | | | |
|---|---|---|---|---|
| 2,337,039 A | | 12/1943 | Gardner, Jr. | |
| 2,570,946 A | * | 10/1951 | Hennessey | 206/349 |
| 2,713,965 A | | 7/1955 | Acker | |
| 3,158,308 A | * | 11/1964 | Struble | 206/592 |
| 3,182,885 A | * | 5/1965 | Maio | 206/455 |
| 3,239,127 A | * | 3/1966 | Spencer | 206/521 |
| 3,770,187 A | | 11/1973 | Faires et al. | |
| 5,150,789 A | * | 9/1992 | Bass | 206/396 |
| 5,156,276 A | * | 10/1992 | Lebowitz | 206/588 |
| 5,765,688 A | * | 6/1998 | Bertram et al. | 206/523 |
| 5,769,309 A | * | 6/1998 | Beneroff et al. | 229/167 |
| 5,788,077 A | * | 8/1998 | Sisk | 206/493 |
| 5,899,336 A | * | 5/1999 | Kataoka | 206/592 |

FOREIGN PATENT DOCUMENTS

FR 2590549 A1 * 5/1987 ..... B65D/5/50

* cited by examiner

*Primary Examiner*—J. Mohandesi
(74) *Attorney, Agent, or Firm*—Akin, Gump, Strauss, Hauer & Feld, L.L.P.

(57) ABSTRACT

A unitary blank of foldable material for forming a carton for containing an object during transport and storage, the blank having: a back panel, first side panel, a front panel, a second side panel, a lid, four bottom tabs, two one-piece support flaps, and two split support flaps. The two on-piece support flaps and two split support flaps form an internal support structure in the bottom of the carton formed by folding the unitary blank. Objects or small appliances positioned within the carton are secured in such a manner as to provide additional support and drop protection to the object or appliance. The carton is folded in such a way so as to add structural integrity to the final carton by the use of stabilizing flaps and an internal support structure. The carton is also designed so as to minimize the material used.

18 Claims, 8 Drawing Sheets

CARTON FOR CONTAINING AN OBJECT DURING TRANSPORT AND STORAGE AND UNITARY BLANK THEREFOR

BACKGROUND OF THE INVENTION

This invention relates to folding cartons and blanks therefor, and more particularly to cartons for containing items for transport, storage, and display. More specifically, the present invention relates to a recloseable cardboard carton for shipping and storage of a small appliance such as an iron for ironing fabric, clothes and the like.

The traditional method for shipping is to position objects within the shipping carton in a manner so as to be easily removed. The cartons are typically formed so as to minimize cost resulting in cartons that do not reseal in an effective manner and that lack structural integrity. In order to manufacture such cartons by automation, it is desirable to form these cartons out of a single sheet of material, called a blank, by successively folding the various sides to create the carton.

The use of foldable cardboard and paperboard for shipment and storage is well known. Similarly, the use of boxes with folding flaps for reusability is also well known and is disclosed in U.S. Pat. Nos. 2,337,039; 2,713,965; and 3,770,187.

A problem associated with these cartons is that the object within the carton can be damaged during shipping and handling from manufacturing to the retail display store and even on the floor of the display store due to minimization of materials and therefore the sacrificed structural integrity of the carton.

The present invention provides a carton formed from a unitary blank wherein the carton is used for both shipping, storage, and displaying purposes. The carton is of the recloseable type to allow the object contained therein to be removed and replaced into the carton. The carton is designed with added structural integrity and drop protection by the use of an internal support structure and stabilizing flaps while still minimizing the overall amount of material used to form the carton blank. The object is wedged into the carton by the stabilizing flaps into a specific position thereby providing additional support and drop protection to the object. The internal support structure of the carton is designed to assist in wedging the object into a specific position and provides shock absorption in the event that the carton is dropped with the object in the carton.

BRIEF SUMMARY OF THE INVENTION

Briefly stated, the present invention comprises a unitary blank of foldable material for forming a carton for containing an object during transport and storage. The blank includes a back panel having a top edge, a bottom edge, a first side edge and a second side edge. The blank also includes a first side panel having a front edge, a top edge, a bottom edge and a rear edge hingedly connected to the first side edge of the back panel. A front panel is provided having a top edge, a bottom edge, a first side edge, and a second side edge hingedly connected to said front edge of said first side panel. The blank further includes a second side panel having a top edge, a bottom edge, a front edge hingedly connected to the first side edge of the front panel and a rear edged hingedly connected to the second side edge of the back panel. A lid including a front edge and rear edge is hingedly connected to the back panel top edge. A first bottom tab has a bottom edge and a top edge which is hingedly connected to the bottom edge of the second side panel. A second bottom tab has a bottom edge, a top edge which is hingedly connected to the bottom edge of the back panel and a first support flap slit. A third bottom tab has a bottom edge and a top edge which is hingedly connected to the bottom of the first side panel. A fourth bottom tab has a bottom edge, a top edge which hingedly connected to the bottom edge of the front panel, and a second support flap slit. A first one-piece support flap is included having a top edge, a first side edge, a second side edge, and a bottom edge which is hingedly connected to the bottom edge of the second bottom tab. A second one-piece support flap incorporates a top edge, a first side edge, a second side edge, and a bottom edge which is hingedly connected to the bottom edge of said fourth bottom tab. A first split support flap is provided having a top edge, a first side edge, a second side edge and a bottom edge which is hingedly connected to the bottom edge of the first bottom tab. The first split support flap includes a slit extending between the bottom and top edges. A second split support flap has a top edge, a first side edge, a second side edge, and a bottom edge which is hingedly connected to the bottom edge of the third bottom tab. The second split support flap includes a slit extending between the bottom and top edges.

Briefly stated, the present invention is also directed to a carton formed from a unitary blank of foldable material for containing an object during transport and storage. The carton includes a parallelopiped having opposing first and second end walls, opposing front and back panels, and opposing first and second side panels. An internal support structure extends inwardly from an inside surface of the second end wall. The internal support structure and the second end wall are formed by support flaps extending from at least two of the front, back, first side and second side panels that are folded into a configuration for wedging the object into a specific position.

BRIEF DESCRIPTION OF THE SEVERAL VIEWS OF THE DRAWINGS

The foregoing summary, as well as the following detailed description, will be better understood when read in conjunction with the appended drawings. For the purpose of illustrating the invention, an embodiment which is presently preferred is shown in the drawings. It should be understood, however, that the invention is not limited to the precise arrangements and instrumentalities shown.

In the drawings.

DETAILED DESCRIPTION OF THE INVENTION

Figure 1:
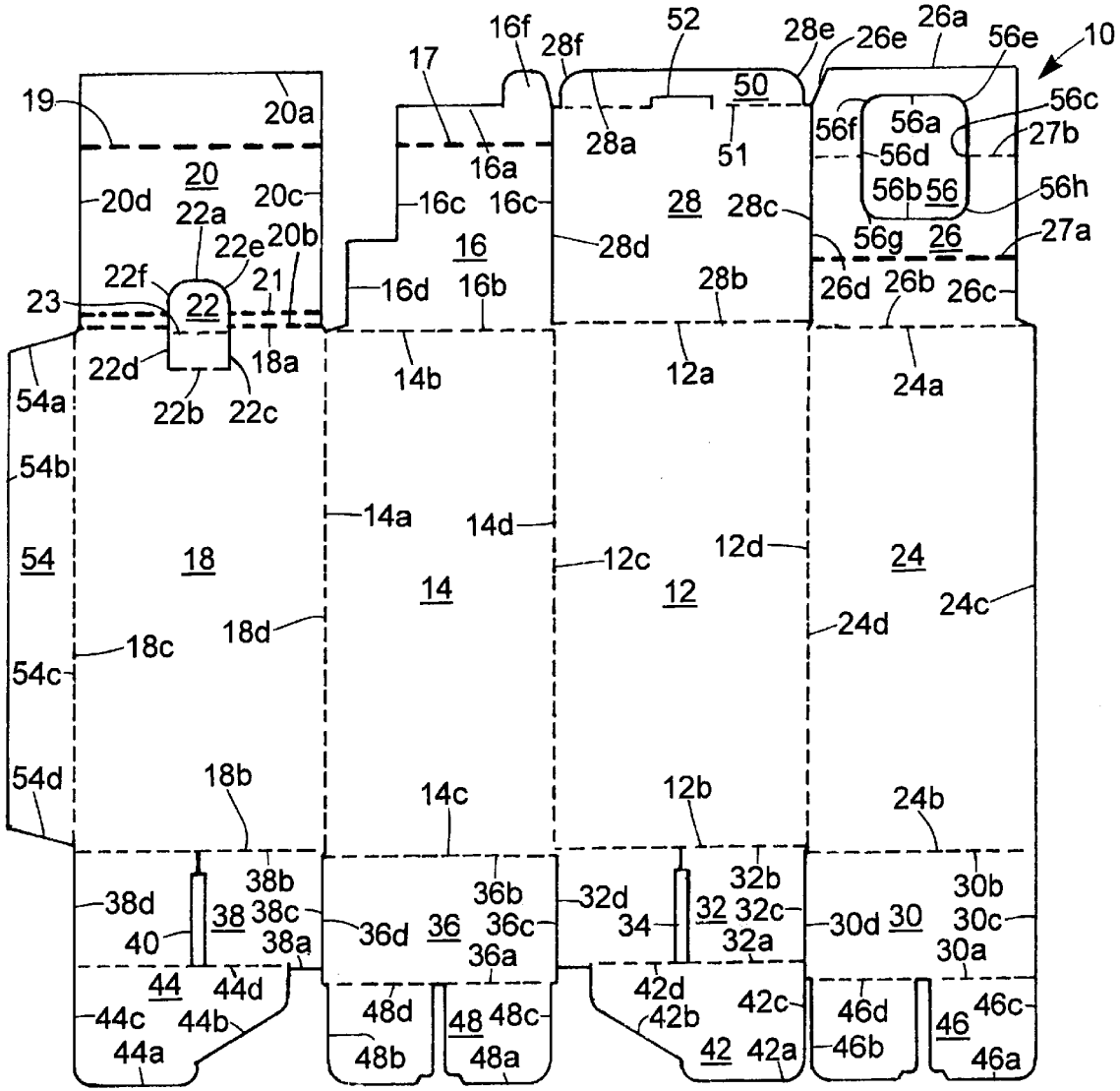
FIG. 1 is a top plan view of a blank for forming a carton in accordance with a preferred embodiment of the present invention.
Figure 2:
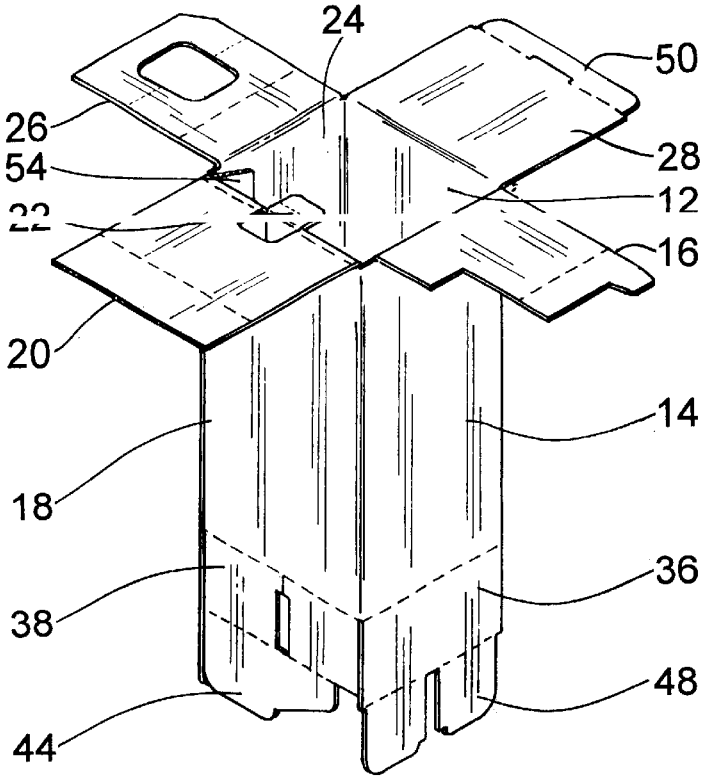
FIG. 2 is a top perspective view of a carton in accordance with a preferred embodiment of the present invention wherein the flaps have yet to be placed in the folded position.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the carton, blank and designated parts thereof. The terminology includes the words above specifically mentioned, derivatives thereof and words of similar import. Additionally, the word "a" is used in the claims and in the corresponding portions of the specification, means "at least one".

Referring now to the drawings in detail, wherein like numerals indicate like elements throughout, there is shown in FIGS. 1–14 a preferred embodiment of a carton in accordance with the present invention shown in both blank and assembled forms.

FIG. 1 illustrates a unitary, one-piece blank 10 which is used to form a carton 11 for containing an object, appliance or item (not shown, hereafter "object") for transport and storage. In the present embodiment, it is preferred that the object to be stored within the carton 11 formed by the blank 10 be an iron for ironing fabric, clothes, or the like (not shown). However, it is understood by those of ordinary skill in the art that the present invention is not limited to any particular type of object or item to be stored within the carton 11 formed by the blank 10.

The blank 10 is preferably made of a generally continuous sheet of paperboard, cardboard, polymeric material or any other suitable material. However, it is understood by those of ordinary skill in the art from reading this disclosure, that the present invention is not limited to making the blank 10 of any particular material.

The blank 10 includes a generally rectangular back panel 12 having a top edge 12*a*, bottom edge 12*b*, a first side edge 12*c*, and a second side edge 12*d*. The back panel need not be rectangular. A first generally rectangular side panel 14 has a front edge 14*a*, a top edge 14*b*, a bottom edge 14*c*, and a rear edge 14*d*. The first side panel 14 is preferably the same size and shape as the back panel 12 but need not be. The rear edge 14*d* of the side panel 14 is hingedly connected to the first side edge 12*c* of the back panel 12. A first side stabilizing flap 16 has a top edge 16*a*, a bottom edge 16*b*, a rear edge 16*c*, a first front edge riser 16*d*, and a second front edge riser 16*e*. The first side stabilizing flap 16 is hingedly connected to the top edge 14*b* of the first side panel 14. The first and second front edge risers 16*d* and 16*e* form a staircase like edge along the front of the first stabilizing flap 16. The distance from the rear edge 16*c* to the front edge 16*d* of the first side stabilizing flap 16 is slightly less than the corresponding width from the front edge 14*a* to the rear edge 14*d* of the first side panel 14. Similarly, the distance from the rear edge 16*c* to the second front edge 16*e* of the first side stabilizing flap 16 is less than the corresponding width from the first front edge 16*d* to the rear edge 16*c* of the first side stabilizing flap 16. The risers 16*d*, 16*e* are formed by removing the material of the unitary blank 10 in the area outside the staircase shaped riser combination. The first stabilizing flap 16 further comprises a tongue shaped member 16*f* along the top edge 16*a* of the first stabilizing flap 16 proximate to the rear edge 16*c* of the first side stabilizing flap 16. The tongue shaped member 16*f* may be other shapes. The tongue shaped member 16*f* is used to provide additional stability to the carton 11 formed from the unitary blank 10 and in particular to wedge together other flaps described below and the object stored therein.

As used herein, the term "hingedly connected" is used to mean, with respect to cardboard, forming a score line in the cardboard for permitting the cardboard to bend with respect to itself. In FIG. 1, score lines are represented by dashed lines. However, it is understood by those of ordinary skill in the art of this disclosure, that the present invention is not limited to forming a hinged connection between panels by forming a score line in cardboard. Perforated, partially slotted, etc., could be used without departing from the spirit and scope of the invention.

The unitary blank 10 has a front panel 18 having a top edge 18*a*, a bottom edge 18*b*, a first side edge 18*c*, and a second side edge 18*d*. The front panel 18 is preferably the same size and shape as the rear panel 12, but need not be. The second side edge 18*d* of the front panel 18 is hingedly connected to the front edge 14*a* of the first side panel 14. A front stabilizing flap 20 has a top edge 20*a*, a bottom edge 20*b*, a first side edge 20*c*, and a second side edge 20*d*. The front stabilizing flap 20 is hingedly connected to the top edge 18*a* of the front panel 18. The front stabilizing flap 20 further comprises a front stabilizing flap scoreline 21 proximate to and substantially parallel to the bottom edge 20*b* of the front stabilizing flap 20. The front stabilizing flap 20 is preferably rectangular, but may be other shapes. The distance between the front stabilizing flap scoreline 21 and the bottom edge 20*b* of the front stabilizing flap 20 is generally related to the thickness of the material of construction of the unitary blank and the radius of curvature of corners formed by folding the front stabilizing flap 20 as described below. The front stabilizing flap 20 also includes a front stabilizing flap crease line 19 proximate to and substantially parallel to the top edge 20*a* of the front stabilizing flap 20. But, the front stabilizing flap crease line 19 need not be parallel to the top edge 20*a* of the front stabilizing flap 20 and may be in other orientations on the front stabilizing flap 20. The front stabilizing flap crease line 19 may be beneficial for folding the unitary blank 10 when forming a carton, since the front stabilizing flap may be longer than an opening formed by folding the front panel 18, rear panel 12, and side panels 14, 24 into a parallelepiped. An insert tab 22 is cut partially in the front panel 18 and partially from the front stabilizing flap 20. The insert tab 22 has a top edge 22*a*, a bottom edge 22*b*, a first side edge 22*c* and a second side edge 22*b*. The insert tab 22 is hingedly connected on the bottom edge 22*b* to a portion of a front panel 18, and is formed by cutting through the material along the first side edge 22*c*, the top edge 22*a*, and the second side edge 22*d* of the insert tab 22. The insert tab 22 is generally rectangular, but the insert tab 22 may be other shapes. The insert tab 22 may include chamfered or rounded corners 22*e*, 22*f* between the top edge 22*a* and the fist side edge 22*c* and between the top edge 22*a* and the second side edge 22*d* of the insert tab 22, respectively. The corners 22*e* and 22*f* of the insert tab 22 may also be squared or other shapes. The insert tab 22 further includes an insert tab fold line 23 that traverses the insert tab 22 slightly below an imaginary line defined by the top edge 18*a* of the front panel 18. The fold line 23 may be located in other orientations on the insert tab 22.

A second side panel 24 has a top edge 24*a*, a bottom edge 24*b*, a front edge 24*c* and a rear edge 24*d*. The second side panel 24 is preferably the same size and shape as the first side panel 14, but need not be. The rear edge 24*d* of the second side panel 24 is hingedly connected to the second side edge 12*d* of the back panel 12. A second side stabilizing flap 26 has a top edge 26*a*, a bottom edge 26*b*, a front edge 26*c*, and a rear edge 26*d*. The second side stabilizing flap 26 is hingedly connected to the top edge 24*a* of the second side panel 24. The second side stabilizing flap 26 is similar in shape and length to the front stabilizing flap 20, but may be other shapes. The second side stabilizing flap 26 is preferably not as wide as the second side panel 24. The second side stabilizing flap 26 further includes a first fold line 27*a* and a second fold line 27*b*. The first fold line 27*a* of the second side stabilizing flap 26 traverses the second side stabilizing flap 26 from the front edge 26*c* to the rear edge 26*d*, and the first fold line 27*a* is preferably proximate to and parallel to the bottom edge 26*b* of the second side stabilizing flap 26. The first fold line 27*a* of the second side stabilizing flap 26 need not be parallel to the bottom edge 26*b* of the second side stabilizing flap 26, and may be in other orientations and locations on the second side stabilizing flap 26. The distance between the first fold line 27*a* of the second side stabilizing flap 26 and the bottom edge 26*b* of the first stabilizing flap is generally determined by the size and shape of the object (not shown) that may be stored in the carton 11 formed from folding the unitary blank 10. The second fold line 27*b* of the second side stabilizing flap 26 is generally parallel to the first fold line 27*a* of the second side stabilizing flap 26, and is located between the first fold line 27*a* and the top edge 26*a* of the second side stabilizing flap 26. The second fold line 27*b* may be cut or creased deeper than the first fold line 27*a* of the second side stabilizing flap 26 in order to allow the second fold line 27*b* to be folded at an acute angle as described below. A chamfer or rounded corner 26*e* may be formed between the top edge 26*a* and the rear edge 26*d* of the second side stabilizing flap 26. The corner 26*e* of the second side stabilizing flap 26 may be other shapes as well. The second side stabilizing flap 26 also has a receiving hole 56 cut from a generally central area between the first fold line 27*a*, the top edge 26*a*, the front edge 26*c* and the rear edge 26*d* of the second side stabilizing panel 26. The hole 56 has a top edge 56*a*, a bottom edge 56*b*, a front edge 56*c*, and a rear edge 56*d*. The hole 56 is preferably rectangular, but need not be, and is preferably symmetrical as viewed in relation to the second fold line 27*b* of the second side stabilizing flap 26. The hole 56 may have rounded or chamfered corners 56*e*, 56*f*, 56*g*, 56*h* between the top edge 56*a* and the front edge 56*c*, the top edge 56*a* and the rear edge 56*d*, the bottom edge 56*b* and the rear edge 56*d*, and the bottom edge 56*b* and the front edge 56*c*, respectively. The corners 56*e*, 56*f*, 56*g*, 56*h* may also be squared or other shapes. The hole 56 is generally sized based upon the size and shape of the object (not shown) to be stored in a carton 11 formed from folding the unitary blank 10.

A lid 28 includes a front edge 28*a*, a rear edge 28*b*, a first side edge 28*c*, and a second side edge 28*d*. The lid 28 is preferably the same length and shape as the front stabilizing flap 20, but need not be. The width of the lid 28 as measured from the first side edge 28*c* to the second side edge 28*d* is slightly wider than the width of the rear panel 12 as measured from the first side edge 12*c* to the second side edge 12*d*. However, the lid 28 may be other widths. The rear edge 28*b* of the lid 28 is hingedly connected to the top edge 12*a* of the back panel 12. Chamfered or rounded corners 28*e*, 28*f* may extend between the front edge 28*a* and the first side edge 28*c* and between the front edge 28*a* and the second side edge 28*d* of the lid 28, respectively. But, the corners 28*e*, 28*f* of the lid 28 may be squared or other shapes. The lid 28 further comprises a closing flap fold line 51 that traverses the lid 28 from the first side edge 28*c* to the second side edge 28*d* of the lid 28. The closing flap fold line 51 is preferably parallel to and proximate to the front edge 28*a* of the lid 28, but may be in other orientations and locations on the lid 28. The closing flap fold line 51 is located a distance, as measured from the rear edge 28*b*, approximately equivalent to the width of the first side panel 14 as measured between the front edge 14*a* and the rear edge 14*d* of the first side panel 14. The area between the closing flap fold line 51 and the front edge 28*a* of the lid 28 defines the closing flap 50. The lid 28 also includes a tab receiving slot 52 cut along a portion of the length of the closing flap fold line 51. The tab receiving slot 52 is preferably symmetrical as viewed relative to the imaginary mid-point of the closing flap fold line 51. The tab receiving slot 52 is preferably slightly wider than the insert tab 22. In one preferred embodiment shown in FIG. 1, the tab receiving slot 52 is cut in a squared, U-shaped form extending into the closing flap 50 from the closing flap fold line 51. The tab receiving slot 52 may be cut in other shapes and orientations.

A first bottom tab 30 has a bottom edge 30*a*, a top edge 30*b*, a first side edge 30*c* and a second side edge 32*d*. The first bottom tab 30 is preferably rectangular in shape and is at least as wide as the second side panel 24. The first bottom tab 30 has a length slightly less than one half the width of back panel 12. But, the first bottom tab 30 may be other shapes. The top edge 30*b* is hingedly connected to the bottom edge 24*b* of the second side panel 24.

A second bottom tab 32 has a bottom edge 32*a*, a top edge 32*b*, a first side edge 32*c*, and a second side edge 32*d*. The second bottom tab 32 is preferably rectangular in shape and has a width slightly less than the width of back panel 12. The top edge 32*b* of the second bottom tab 32 is hingedly connected to the bottom edge 12*b* of the back panel 12. The second bottom tab 32 further includes a first support flap slit 34 proximate to the imaginary midpoint of the bottom edge 32*a* of the second bottom tab 32. The first support flap slit 34 extends from the bottom edge 32*a* of the second bottom tab 32, but does not completely traverse the second bottom tab 32. The first support flap slit 34 may be a single cut in the second bottom tab 32, but the first support flap slit 34 is preferably a rectangular shaped hole with a width slightly larger than twice the thickness of the material of the unitary blank 10.

A third bottom tab 36 has a bottom edge 36*a*, a top edge 36*b*, a first side edge 36*c*, and a second side edge 36*d*. The third bottom tab 36 is preferably similar in size and shape to the first bottom tab 30, but need not be. The top edge 36*b* of the third bottom tab 36 is hingedly connected to the bottom edge 14*c* of the first side panel 14.

A fourth bottom tab 38 has a bottom edge 38*a*, a top edge 38*b*, a first side edge 38*c*, and a second side edge 38*d*. The fourth bottom tab 38 is preferably the same size and shape as the second bottom tab 32, but may be other sizes and shapes. The top edge 38*b* of the fourth bottom tab 38 is hingedly connected to the bottom edge 18*b* of the front panel 18. The fourth bottom tab 38 further includes a second support flap slit 40 proximate to the imaginary midpoint of the bottom edge 38*a* of the fourth bottom tab 38. The second support flap slit 40 extends from the bottom edge 38*a* of the fourth bottom tab 38, but does not completely traverse the fourth bottom tab 38. The second support flap slit 40 may be a single cut in the fourth bottom tab 38, but the second support flap slit 40 is preferably a rectangular shaped hole with a width slightly larger than twice the thickness of the material of the unitary blank 10. The second support flap slit 40 is preferably the same size and shape as the first support flap slit 34, but the support flap slits 34, 40 may be different shapes without diverging from the present invention.

A first one-piece support flap 42 has a top edge 42*a*, a first side edge 42*b*, a second side edge 42*c*, and a bottom edge 42*d*. The bottom edge 42*d* of the first one-piece support flap 42 is hingedly connected to the bottom edge 32*a* of the second bottom tab 32. A second one-piece support flap 44 has a top edge 44*a*, a first side edge 44*b*, a second side edge 44*c*, and a bottom edge 44*d*. The bottom edge 44*d* of the second one-piece support flap 44 is hingedly connected to the bottom edge 38*a* of the fourth bottom tab 38. The one-piece support flaps 42, 44 may be almost as wide as the bottom tabs 36, 38. The first side edge 42*b*, 44*b* of each one-piece support flap 42, 44 extends at an acute angle with respect to each bottom edge 42*d*, 44*d*.

A first split support flap 46 has a top edge 46*a*, a first side edge 46*b*, a second side edge 46*c* and a bottom edge 46*d*. The bottom edge 46*d* of the first split support flap 46 is hingedly connected to the bottom edge 30*a* of the first bottom tab 30. The first split support flap 46 also has a slit extending between the bottom edge 46*d* and top edge 46*a* at approximately the imaginary midpoint of the bottom edge 46*d* of the first split support flap 46. The slit in the first split support flap 46 may merely be a cut in the material, but the slit in the first split support flap 46 is preferably a rectangular portion of material removed from the first split support flap 46 that is symmetrical about an imaginary line dividing the first split support flap 46 into equal portions between the first side edge 46*b* and the second side edge 46*c* of the first split support flap 46. The first split support flap 46 further comprises symmetrical notches at the end of the slit in the first split support flap 46 proximate to the top edge 46*a* of the first split support flap 46.

A second split support flap 48 has a top edge 48*a*, a first side edge 48*b*, a second side edge 48*c* and a bottom edge 48*d*. The bottom edge 48*d* of the second split support flap 48 is hingedly connected to the bottom edge 36*a* of the third bottom tab 36. The second split support flap 48 includes a slit extending between the bottom edge 48*d* and top edge 48*a* at approximately the imaginary midpoint of the bottom edge 48*d* of the second split support flap 48. The slit in the second split support flap 48 may merely be a cut in the material, but the slit in the second split support flap 48 is preferably a rectangular portion of material removed from the second split support flap 48 that is symmetrical about an imaginary line dividing the second split support flap 48 into equal portions between the first side edge 48*b* and the second side edge 48*c* of the second split support flap 48. The second split support flap 48 further comprises symmetrical notches at the end of the slit in the second split support flap 48 proximate to the top edge 48*a* of the second split support flap 48. The second split support flap 48 is preferably split in a similar manner to the first split support flap 46, but need not be. The top edges 46*a*, 48*a* of the split support flaps 46, 48 have a first rounded corner extending between the first side edge 46*b*, 48*b* and the top edge 46*a*, 48*a*, and a second rounded corner extending between the second side edge 46*c*, 48*c* and the top edge 46*a*, 48*a*. The first split support flap 46 may have a generally narrow portion of material removed from the area between the bottom edge 46*d* and the top edge 46*a* proximate the second side edge 46*b* of the first split support flap 46 such that there is a distinct gap between the second side edge 46*b* of the first split support flap 46 and the second side edge 42*c* of the first one-piece support flap 42. The second split support flap 48 may have a generally narrow portion of material removed from the area between the bottom edge 48*d* and the top edge 48*a* proximate the first side edge 48*b* and the second side edge 48*c* of the second split support flap 48, such that the width of the second split support flap 48 as measured between the first side edge 48*b* and the second side edge 48*c* of the second split support flap is slightly less than the width of the third bottom tab 36 as measured between the first side edge 36*c* and the second side edge 36*d* of the third bottom tab 36.

The unitary blank 10 of foldable material has a size in the range of 2.75–3.25 square feet. The foldable material may be cardboard, paperboard, polymeric material or the like. The material is preferably between about 0.5 mm and 4 mm thick. The material is preferably corrugated cardboard, but may be any corrugated, single layered, multi-layered, or double walled material, or the like.

A glue flap 54 has a top edge 54*a*, a first side edge 54*b*, a second side edge 54*c*, and a bottom edge 54*d*. The second side edge 54*b* of the glue flap 54 may be hingedly connected to the first side edge 18*c* of the front panel 18. The top edge 54*a* preferably extends at a slight angle from the second side edge 54*c* to the first side edge 54*b* of the glue flap 54. The bottom edge 54*d* preferably extends at a slight angle from the second side edge 54*c* to the first side edge 54*b* of the glue flap 54. The glue flap 54 is then preferably a symmetrically shaped trapezoid with the first side edge 54*b* being shorter than the second side edge 54*c* of the glue flap 54. But, the glue flap 54 may be rectangular or other shapes. The glue flap 54, as described in greater detail below, is for applying an adhesive or other mechanisms of attachment to join the glue flap 54 to the inside surface of the second side panel 24 when folding the unitary blank 10 into the carton 11.

Figure 10:
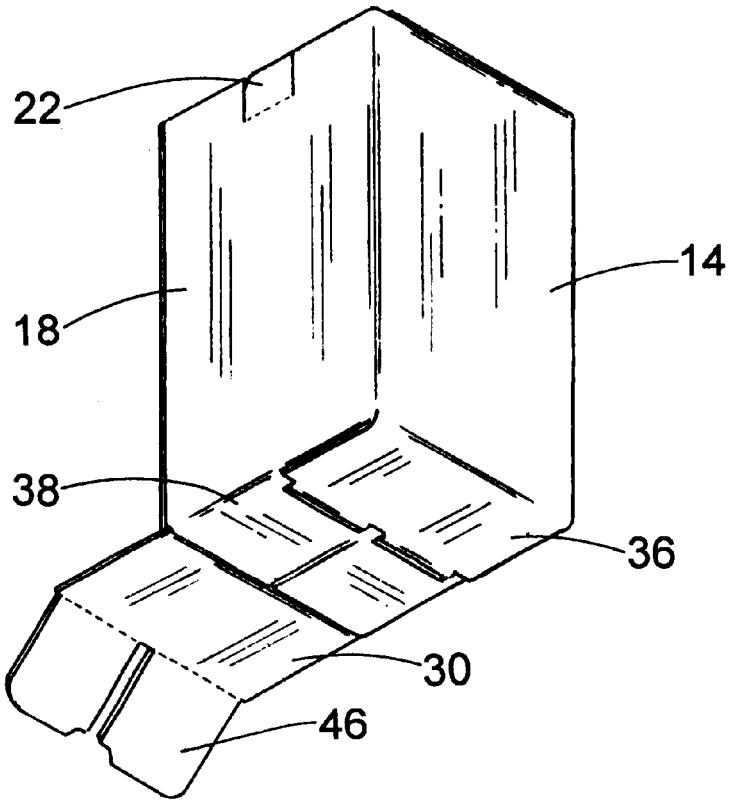
FIG. 10 is a bottom perspective view of the carton shown in FIG. 2 with three of the second end flaps in the folded position.
Figure 11:
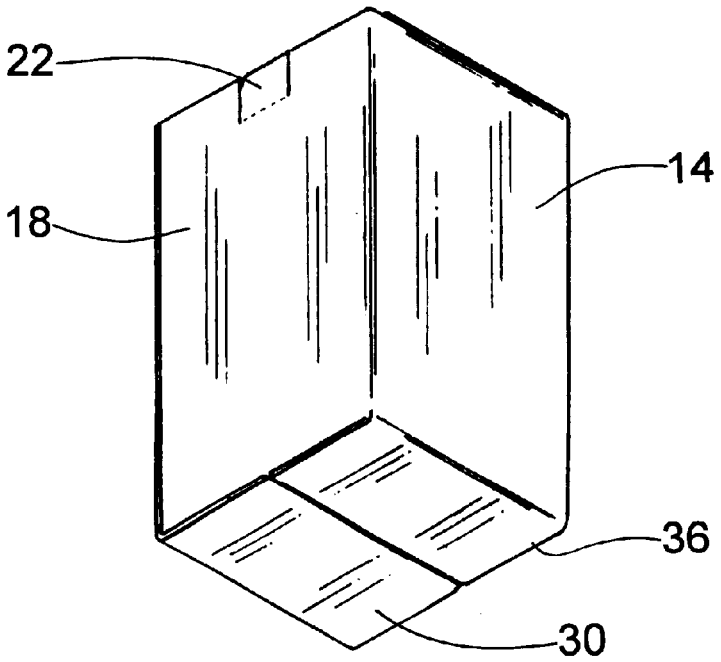
FIG. 11 is a bottom perspective view of the carton shown in FIG. 2 in an assembled form.
Figure 12:
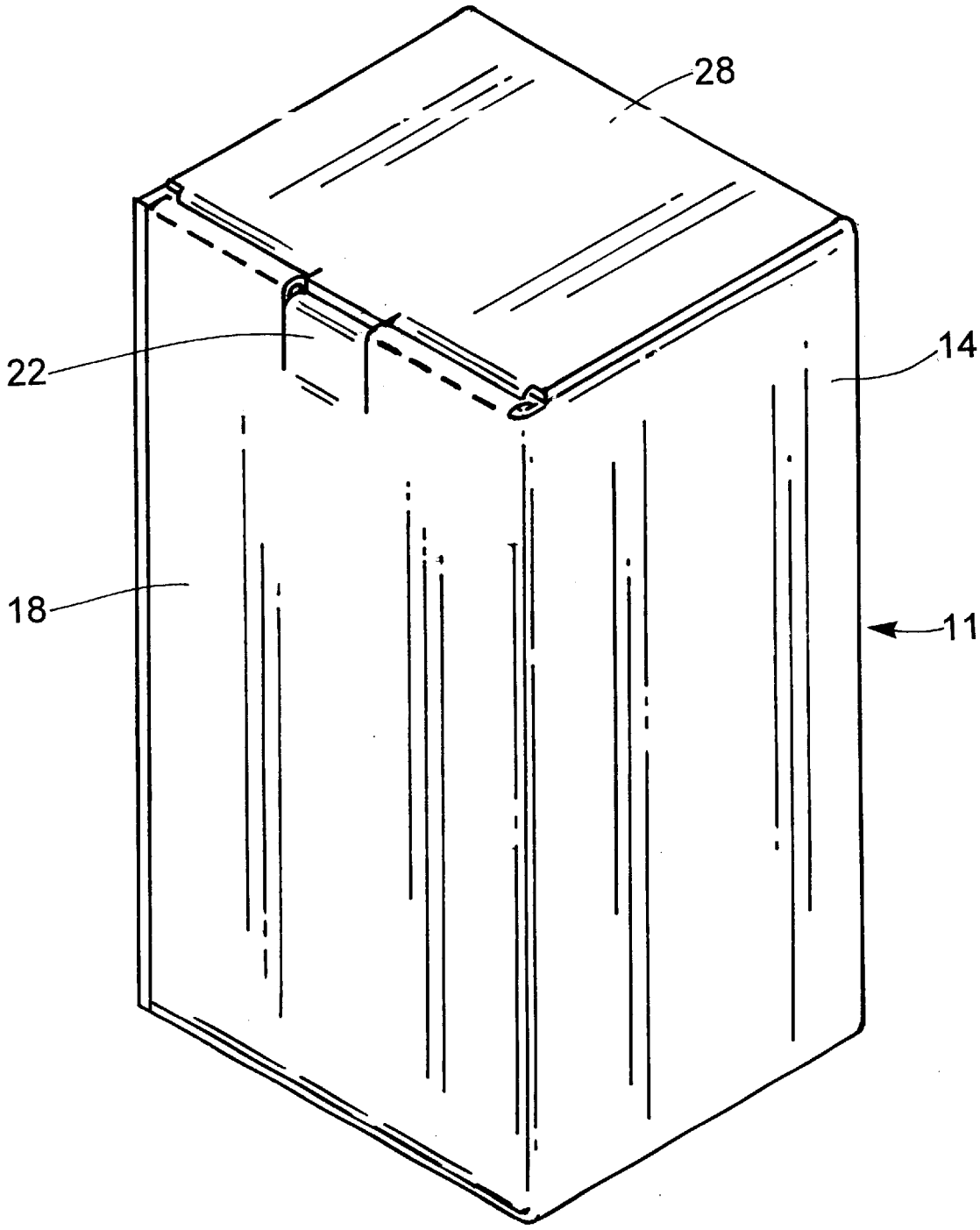
FIG. 12 is a enlarged top perspective view of the carton shown in FIG. 2 in the assembled form.

FIGS. 2–11 show a preferred series of steps used to form the carton 11 from the unitary blank 10, as shown completed in FIG. 12. The second side panel 24 is folded along the score line located at the rear edge 24*d*, to a position perpendicular to the back panel 12. The first side panel 14 is folded along a score line located at the rear edge 14*d* of the first side panel 14 to a position perpendicular to the back panel 12 and parallel to the folded position of the second side panel 24. The front panel 18 is folded along a score line located at the second side edge 18*d* to a position perpendicular to the first side panel 14 and parallel to the back panel 12. The glue flap 54 is folded along a score line located at the second side edge 54*c* to a position perpendicular to the front panel 18. In the preferred embodiment, the glue flap 54 is positioned within the carton 11 for cosmetic purposes and is attached proximate to the front edge 24*c* of the second side panel 24 with an adhesive such as liquid glue formed from a chemical solvent mixture. However, it would be appreciated by those skilled in the art that other means, such as staples or other mechanical fasteners, tape or some other type of adhesive, may be used for joining the glue flap 54 to the second side panel 24.

Figure 3:
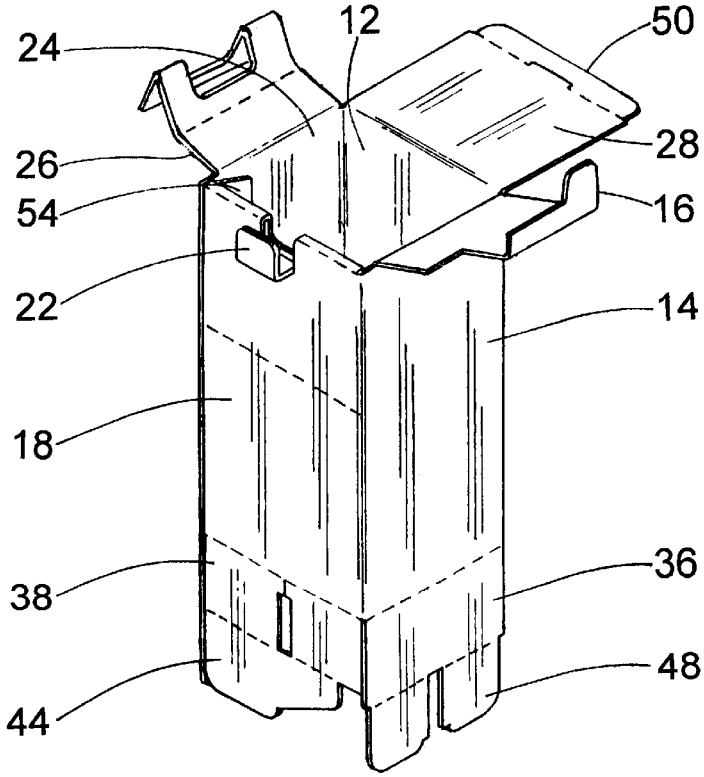
FIG. 3 is a top perspective view of the carton shown in FIG. 2 with one of the flaps in the folded position.

As shown in FIG. 3, the front stabilizing flap 20 is folded along the top edge 18*a* of the front panel 18 and front stabilizing flap score line 21 so that it is substantially parallel with the front panel 18 and is located inside the carton 11. It may be necessary to slightly bend the front stabilizing flap 20 along crease line 19 in order to maneuver the front stabilizing flap 20 into the carton 11. The insert tab 22 is folded along the bottom edge 22*b* of the insert tab 22 so that the insert tab 22 is perpendicular to the front panel 18. The insert tab 22 is folded again along the insert tab score line 23 so that the area of the insert tab 22 between the top edge 22*a* of the insert tab 22 and the insert tab score line 23 is parallel to the front panel 18. The first side stabilizing flap 16 is folded along the first side stabilizing flap score line 17 such that the area between the first side stabilizing flap score line 17 and the top edge 16*a* of the first side stabilizing flap 16 is perpendicular to the remaining area of the first side stabilizing flap 16. The second side stabilizing flap 26 is folded along the first fold line 27*a* so that the area of the second side stabilizing flap 26 between the first fold line 27*a* and the top edge 26*a* of the second side stabilizing flap 26 is at an obtuse angle to the remaining portion of the second side stabilizing flap 26. The second side stabilizing flap 26 is then folded along the second fold line 27*b* at an acute angle away from the inside of the carton 11.

Figure 4:
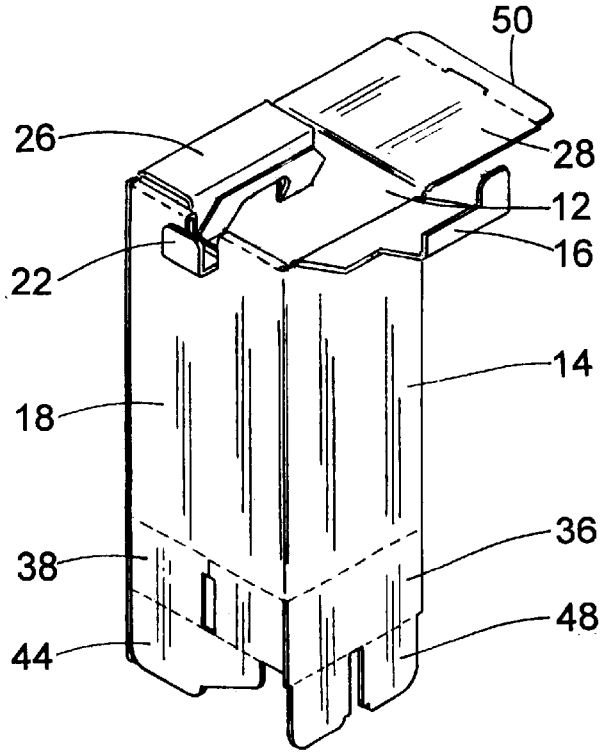
FIG. 4 is a top perspective view of the carton shown in FIG. 2 with two of the flaps in the folded position.

As shown in FIG. 4, the second side stabilizing flap 26 is folded along a score line located at the top edge 24*a* of the second side panel 24 to a position perpendicular with the second side panel 24 such that the area of the second side stabilizing flap 26 between the first fold line 27*a* and the top edge 26*a* of the second side stabilizing flap 26 is substantially inside carton 11. The second side stabilizing flap 26 may again be adjusted by creasing along the first and second score lines 27*a*, 27*b* in order to accommodate an object that may be stored inside the carton 11 as necessary.

Figure 5:
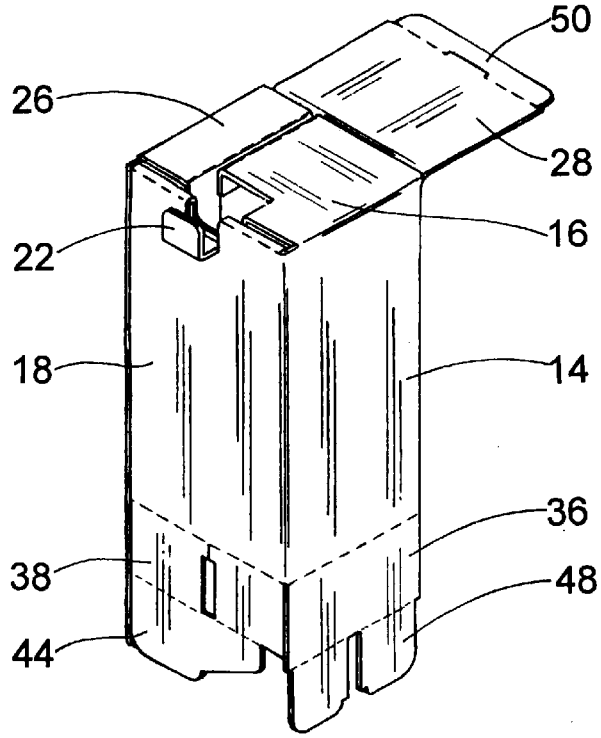
FIG. 5 is a top perspective view of the carton shown in FIG. 2 with three of the flaps in the folded position.

As shown in FIG. 5, the first side stabilizing flap 16 is folded along a score line located at the tope edge 14*b* of the first side panel 14 such that it is perpendicular with the first side panel 14 such that the area of the first side stabilizing flap 16 between the first side stabilizing flap score line 17 and the top edge 16*a* of the first side stabilizing flap 16 is substantially inside the carton 11. The first side stabilizing flap may be further adjusted by creasing along score line 17 in order to support the second side stabilizing flap 26 and the object inside the carton 11 more tightly.

Figure 6:
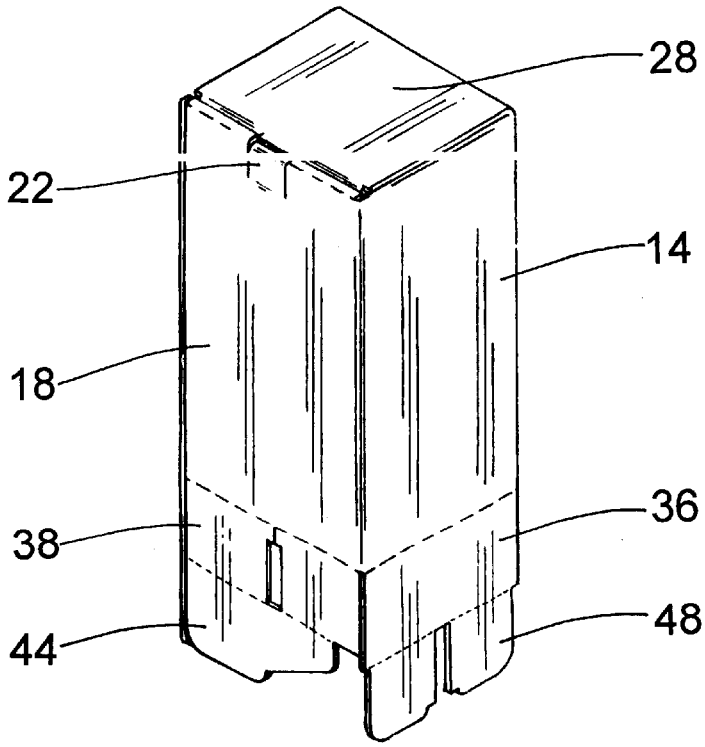
FIG. 6 is a top perspective view of the carton shown in FIG. 2 with four of the flaps in the folded position.

As shown in FIG. 6, the lid 28 is folded along a score line located at the rear edge 28*b* to a position perpendicular to the back panel 12. The closing flap 50 is folded along a score line located at the front edge 28*a* of the lid 28 to a position perpendicular to the lid 28 and parallel to the front panel 18, and the closing flap 50 is then positioned within the carton 11 substantially adjacent to the front panel 18. The top edge 22*a* of the insert tab 22 is then inserted into the tab receiving slot 52 until the portion of the insert tab between the insert tab fold line 23 and the bottom edge 22*b* of the insert tab 22 is flush with the front panel 18. The insert tab 22 and the tab receiving slot 52 form a locking mechanism which keeps the lid 28 from lifting.

Figure 7:
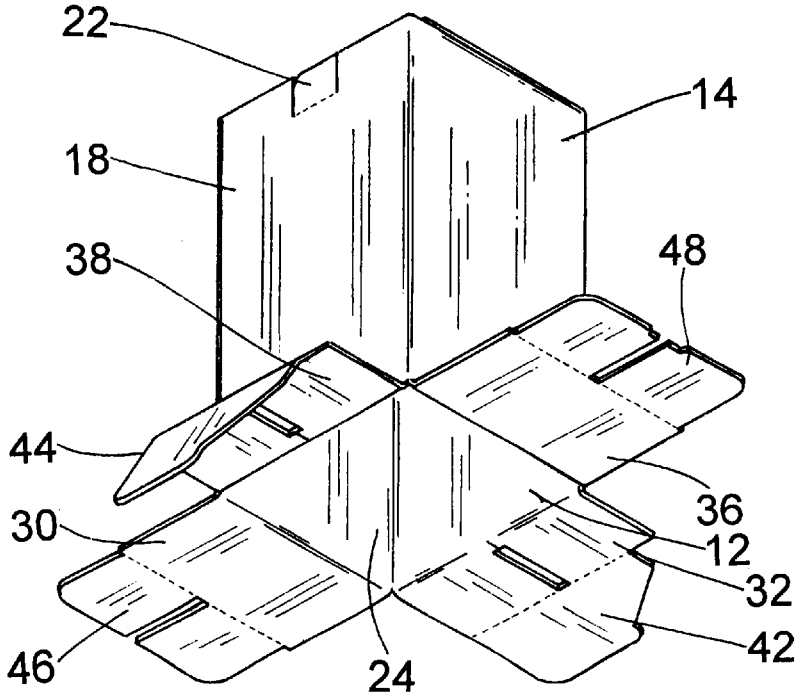
FIG. 7 is a bottom perspective view of the carton shown in FIG. 2 with the first end flaps in a folded position and the second end flaps in a partially folded position.

As shown in FIG. 7, the second one-piece support flap 44 if folded along a score line located at the bottom edge 44*d* of the second one-piece support flap 44 to a position perpendicular with the fourth bottom tab 38.

Figure 8:
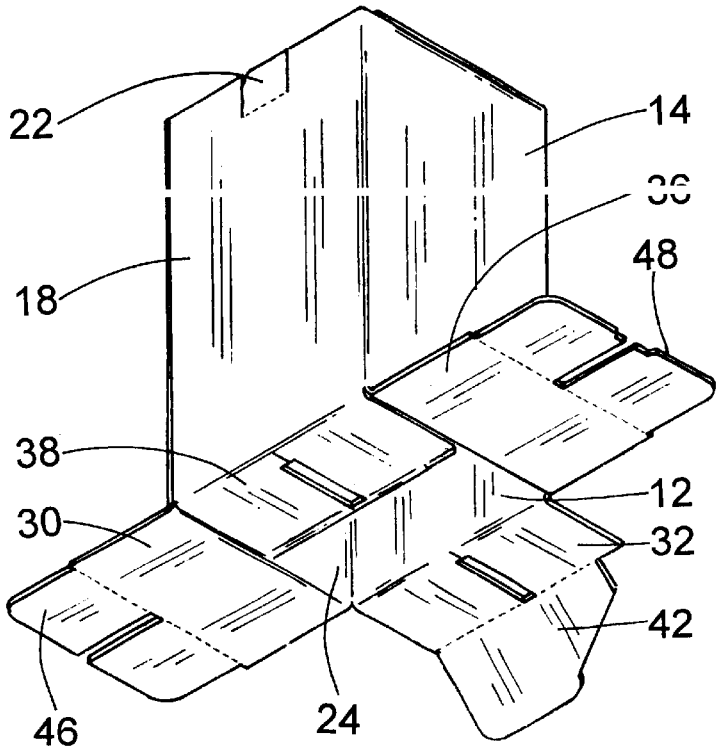
FIG. 8 is a bottom perspective view of the carton shown in FIG. 2 with one of the second end flaps in the folded position.

As shown in FIG. 8, fourth bottom tab 38 is folded along a score line located at the top edge 38*b* of the fourth bottom tab 38 such that the fourth bottom tab 38 is perpendicular to the front panel 18 and the second one-piece support flap 44 is substantially inside the carton 11 and parallel to the front panel 18. The first one-piece support tab 42 is folded along a score line located at the bottom edge 42*d* of the first one-piece support tab 42 such that the first one-piece support tab 42 is perpendicular to the second bottom tab 32.

Figure 9:
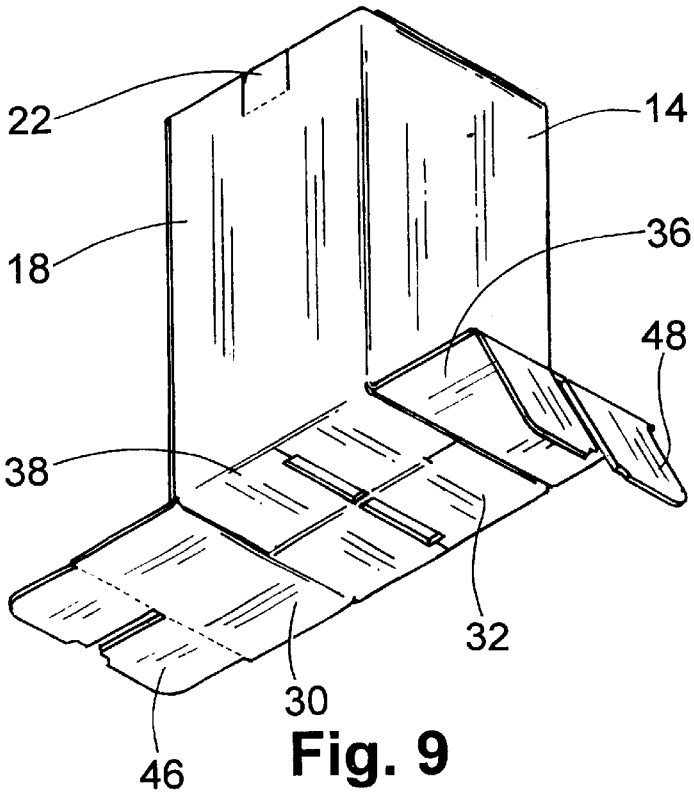
FIG. 9 is a bottom perspective view of the carton shown in FIG. 2 with two of the second end flaps in the folded position.

As shown in FIG. 9, the second bottom tab 32 is folded along a score line located at the top edge 32*b* of the second bottom tab 32 to a position perpendicular with the back panel 12 and wherein the first one-piece support flap 42 is located substantially within the carton 11 and is parallel to the back panel 12. Thus, the second one-piece support flap 44 is preferably substantially adjacent to the first one-piece support flap 42 inside the carton 11. The second split support flap 48 is folded along a score line located at the bottom edge 48*d* of the second split support flap 48 such that the second split support flap 48 is perpendicular to the third bottom tab 36.

As shown in FIG. 10, the third bottom tab 36 is folded along a score line located at the top edge 36*b* to a position perpendicular with the first side panel 14 wherein the second split support flap 48 slides into the first and second support flap slits 34, 40. The first split support flap 46 is folded along a score line located at the bottom edge 46*d* of the first split support flap 46 to a position perpendicular with the first bottom tab 30.

Figure 13:
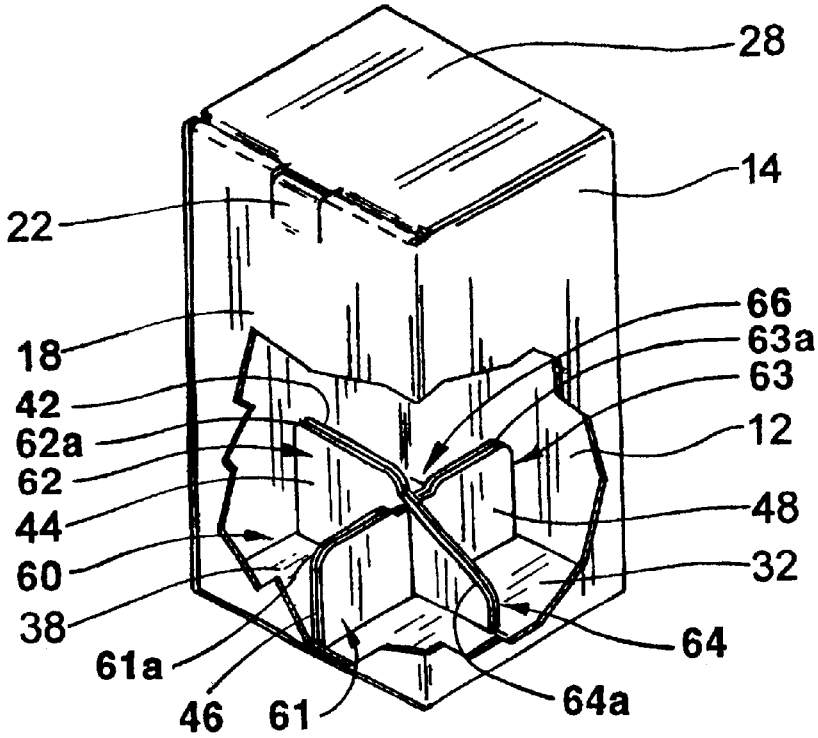
FIG. 13 is a top perspective view of the carton shown in FIG. 12, partially broken away.

As shown in FIG. 11, the first bottom tab 30 is folded along a score line located at the top edge 30*b* of the first bottom tab 30 to a position perpendicular to the second side panel 24 wherein the first split support flap 46 slides into the first and second support flap slits 34, 40. Thus, the first split support flap 46 is substantially adjacent to the second split support flap 48 inside the carton 11, and the split support flaps 46, 48 are bisected by the one-piece support flaps 42, 44. The resultant cross structure 60 formed from the split support flaps 46, 48 and the one-piece support flaps 42, 44 is shown in FIG. 13. The cross structure 60 is configured for wedging an object (not shown) into a specific position within the carton 11. One leg 64 of the cross 60 formed by the first side edge 42*b* of the first one-piece support flap 42 and the first side edge 44*b* of the second one-piece support flap 44 is angled in order to support the object (not shown) which has a similar but opposite angled shape, such as the nose of an iron for ironing fabric, clothes, and the like. Specifically, the internal support structure 60 is generally in the form of a cross 60 having first, second, third and fourth legs 61, 62, 63, 64, respectively. In particular, each of the first, second and third legs 61–63 of the cross 60 have a horizontally-straight inwardly-facing edge 61*a*, 62*a*, 63*a*, respectively. An intersection of the first, second and third legs 61–63 forms a stepped-down recess 66 from the horizontally-straight inwardly-facing edges 61*a*, 62*a*, 63*a*. The fourth leg 64 of the cross 60 has an angled inwardly-facing edge 64*a* extending at a downward angle from the stepped-down recess 66 in order to support the object which has a similar, but opposite, angled shape. The support flaps 42 and 46 are substantially adjacent to their like support flaps 44 and 48, respectively, thereby forming two-ply protruding legs 61–64 of the support structure 60.

Referring to FIG. 12, in use, the carton 11 is formed from the blank 10, as described above. In the illustrated embodiment, the object (not shown) is positioned within the carton 11 in a fashion which is conducive to shipping and handling.

Figure 14:
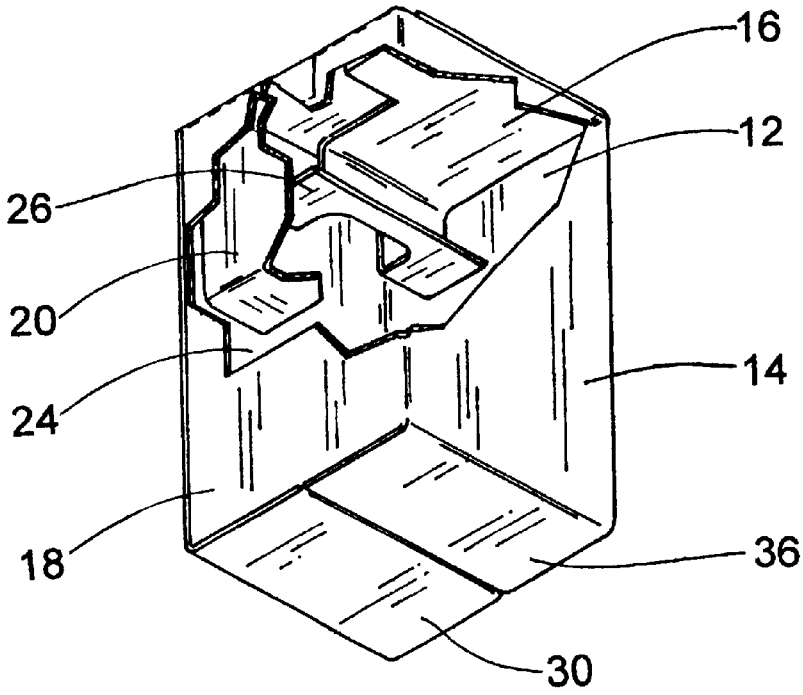
FIG. 14 is a bottom perspective view of the carton shown in FIG. 11, partially broken away.

As shown in FIG. 14, the front stabilizing flap 20 extends into the carton 11 and is adjacent to the front panel 18 in order to provide additional support and drop protection to the object or appliance in the carton 11. The second side stabilizing flap 26 also extends into the carton 11 and is folded into a configuration for wedging the object into a specific position and for adding structural integrity to the carton 11 thereby providing additional drop protection for the object within the carton 11. The hole 56 in the second side stabilizing flap 26 may accommodate a portion of the object while providing equal support on opposite sides of a less than rectangular object within the carton 11. The first side stabilizing flap 16 also extends into the carton 11 and is folded into a configuration for wedging the second side stabilizing flap 26 into a specific position and adds structural integrity to the carton 11 thereby providing additional drop protection to the object or appliance stored within the carton 11. The tongue shaped member 16*f* engages the second side support flap 26 along the second fold line 27*b* of the second side support flap 26 increasing the contact of the second side stabilizing flap 26 with the object within the carton 11.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A unitary blank of foldable material for forming a carton for containing an object during transport and storage, said blank comprising:

(a) a back panel having a top edge, a bottom edge, a first side edge, and a second side edge;

(b) a first side panel having a front edge, a top edge, a bottom edge and a rear edge hingedly connected to the first side edge of said back panel;

(c) a front panel having a top edge, a bottom edge, a first side edge, and a second side edge hingedly connected to said front edge of said first side panel;

(d) a second side panel having a top edge, a bottom edge, a front edge hingedly connected to said first side edge of said front panel and a rear edge hingedly connected to said second side edge of said back panel;

(e) a lid including a front edge and a rear edge hingedly connected to said back panel top edge;

(f) a first bottom tab having a bottom edge and a top edge hingedly connected to said bottom edge of said second side panel;

(g) a second bottom tab having a bottom edge and a top edge hingedly connected to said bottom edge of said back panel and a first support flap slit located in said second bottom tab;

(h) a third bottom tab having a bottom edge and a top edge hingedly connected to said bottom edge of said first side panel;

(i) a fourth bottom tab having a bottom edge and a top edge hingedly connected to said bottom edge of said front panel and a second support flap slit located in said fourth bottom tab;

(j) a first one-piece support flap having a top edge, a first side edge, a second side edge, and a bottom edge hingedly connected to the bottom edge of the second bottom tab;

(k) a second one-piece support flap having a top edge, a first side edge, a second side edge, and a bottom edge hingedly connected to the bottom edge of said fourth bottom tab;

(l) a first split support flap having a top edge, a first side edge, a second side edge, and a bottom edge hingedly connected to the bottom edge of said first bottom tab, said first split support flap including a slit extending the entire span between said bottom and top edges; and (m) a second split support flap having a top edge, a first side edge, a second side edge, and a bottom edge hingedly connected to the bottom edge of said third bottom tab, said second split support flap including a slit extending the entire span between said bottom and top edges.

2. The unitary blank of claim 1 wherein the foldable material is cardboard.

3. The unitary blank of claim 1 wherein the one piece support flaps are almost as wide as the bottom tabs and said first side edge extends at an acute angle with respect to said bottom edge.

4. The unitary blank of claim 1 wherein the top edges of the split support flaps have notched corners proximate the slit, a first rounded corner extending between the first side edge and the top edge and a second rounded corner extending between the second side edge and the top edge.

5. The unitary blank of claim 1 further comprising a closing flap hingedly connected to said front edge of said lid.

6. The unitary blank of claim 5 further comprising a tab-receiving slot on the connection between the lid and the closing flap.

7. The unitary blank of claim 1 further comprising a front stabilizing flap hingedly connected to said top edge of said front panel.

8. The unitary blank of claim 7 further comprising an insert tab cut partially in the front panel and partially from the front stabilizing flap and hingedly connected on one edge to a portion of the front panel.

9. The unitary blank of claim 1 further comprising a first side stabilizing flap hingedly connected to said top edge of said first side panel.

10. The unitary blank of claim 1 further comprising a second side stabilizing flap hingedly connected to said top edge of said second side panel.

11. The unitary blank of claim 1 wherein the blank of foldable material has a size in the range of 2.75 to 3.25 square feet.

12. A carton formed from a unitary blank of foldable material for containing an object during transport and storage, said carton comprising:

(a) a parallelopiped having opposing first end and second end walls, opposing front and back panels, and opposing first and second side panels; and (b) an internal support structure extending inwardly from an inside surface of the second end wall, said internal support structure being formed by support flaps extending from at least two of said front, back, first side and second side panels that are folded into a configuration for wedging the object into a specific position, wherein one of the support flaps is substantially adjacent to another of the support flaps thereby forming a two-ply protruding leg of the support structure.

13. The carton of claim 12 wherein the foldable material is cardboard.

14. The carton of claim 12 wherein the object is an appliance.

15. The carton of claim 14 wherein the appliance is an iron.

16. The carton of claim 12 further comprising a front stabilizing flap hingedly connected to a top edge of said front panel, said stabilizing flap extending inwardly and adjacent to said front panel for providing additional support and drop protection to the object.

17. The carton of claim 12 further comprising a second side panel stabilizing flap hingedly connected to an edge of said second side panel, said second side panel stabilizing flap extending inwardly and folded in a configuration for wedging the object into a specific position and for adding structural integrity to the carton thereby providing additional support and drop protection to the object.

18. The carton of claim 17 further comprising a first side panel stabilizing flap hingedly connected to an edge of said first side panel, said first side panel stabilizing flap extending inwardly and folded in a configuration for wedging said second side panel stabilizing flap into a specific position and for adding structural integrity to the carton thereby providing additional support and drop protection to the object.

* * * * *